US009889682B2

(12) United States Patent
Nijkamp

(10) Patent No.: US 9,889,682 B2
(45) Date of Patent: Feb. 13, 2018

(54) APPARATUS AND METHOD FOR POSITIONING A SUBSTRATE ON A SUPPORT BODY

(71) Applicant: Océ-Technologies B.V., Venlo (NL)

(72) Inventor: Aart Nijkamp, Venlo (NL)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 15/298,607

(22) Filed: Oct. 20, 2016

(65) Prior Publication Data

US 2017/0120629 A1 May 4, 2017

(30) Foreign Application Priority Data

Nov. 3, 2015 (EP) ..... 15192773

(51) Int. Cl.
*B41J 11/00* (2006.01)

(52) U.S. Cl.
CPC ..... *B41J 11/0045* (2013.01); *B41J 11/0085* (2013.01)

(58) Field of Classification Search
CPC ... B41J 11/06; B41J 11/14; B41J 13/10; B41J 13/26; B41J 11/0045; B41J 11/0085; B41J 13/103; B41J 11/42; B41J 11/008; B41J 11/0095; B41J 2/01; B41J 11/0065; B41J 11/005; B41J 11/007; B41J 11/20; B41J 11/003
USPC ..... 347/5, 14, 16, 19, 104
See application file for complete search history.

(56) References Cited

U.S. PATENT DOCUMENTS

2009/0103966 A1 4/2009 Hoy
2010/0079532 A1* 4/2010 Nishimura ..... B41J 11/002 347/16
2010/0190628 A1 7/2010 Gansert et al.

FOREIGN PATENT DOCUMENTS

EP 2 154 000 A1 2/2010

* cited by examiner

*Primary Examiner* — Jannelle M Lebron
(74) *Attorney, Agent, or Firm* — Birch, Stewart, Kolasch & Birch, LLP

(57) ABSTRACT

An apparatus is provided for positioning a substrate on a support body. The apparatus comprises the support body for supporting the substrate, at least one registration element, wherein said at least one registration element is positioned and arranged for registering the substrate in a preselected position on the support body when brought into a registering state. The apparatus further comprises a registration actuator movably arranged with respect to the support body for selectively arranging a registration element into the registering state.

18 Claims, 4 Drawing Sheets

APPARATUS AND METHOD FOR POSITIONING A SUBSTRATE ON A SUPPORT BODY

FIELD OF THE INVENTION

The present invention relates to an apparatus for positioning a substrate on a support body. The present invention further relates to a method for positioning a substrate on a support body.

BACKGROUND ART

A known inkjet printing apparatus comprises a support body and an inkjet print head assembly. The support body is arranged for supporting a substrate. The inkjet print head assembly is movably arranged with respect to the support body for applying inkjet droplets on the substrate, which is arranged on the support body.

The support body comprises an assembly of registration pins arranged at a fixed position on the support body to register a substrate in a predetermined position. The assembly of registration pins comprises a first set of registration pins and a second set of registration pins, the first set of registration pins being arranged along a first linear line which is substantially perpendicular to the second set of registration pins arranged along a second linear line. The assembly of registration pins is positioned for registering a substrate having two edges arranged perpendicular to each other, such as a rectangular substrate. The first line and second line of the assembly of registration pins have a crossing point, which defines the predetermined position of the substrate (e.g. of the corner of the rectangular substrate in a registered state of the substrate).

In this apparatus the position to register the substrate is fixed by the arrangement of the assembly of registration pins. Furthermore, in case more than one substrate fits onto the support body a desire is to register and process multiple substrates on the support body at the same time, wherein each substrate has a position different from one another.

Even more, in order to optimize use of the support body a preferred position of the respective substrates depends on the size and shape of the set of multiple substrates.

Furthermore, the use of the assembly of registration pins for registering a substrate is restricted to substrates having a shape which is conformal to the mutual fixed arrangement of the first set and second set of registration pins.

The known fixed assembly of the registration pins does not allow registration of substrates on another position of the support body and/or registration of substrates having deviant shapes.

SUMMARY OF THE INVENTION

It is accordingly an object of the present invention to provide an apparatus to selectively arrange at least one registration element into a registering state on a support body to provide a flexible arrangement for registering a substrate on the support body in a preselected position, wherein the substrate may have various sizes and shapes.

This object is attained by an apparatus for positioning a substrate on a support body, the apparatus comprising the support body for supporting the substrate, at least one registration element, wherein said at least one registration element is positioned and arranged for registering the substrate in a preselected position on the support body when brought into a registering state; and wherein the apparatus further comprises a registration actuator movably arranged with respect to the support body for selectively arranging a registration element into the registering state.

The registration actuator is movably arranged with respect to the support body to arrange a registration element into the registering state. The registration actuator may be movably arranged above the support body, such as a registration actuator being mounted on a carriage movably arranged with respect to the support body while facing a support surface of the support body.

The registration actuator provides a simple device for actuating a first registration element into the registering state independently of any other registration element.

As such, in case of a desire to register multiple substrates at the same time on the support body, multiple registration elements may be arranged by the registration actuator into the registering state at several positions on the support body based on preselected positions of the substrates, which are selected to cover the support body.

As a result, the use of the support body is optimized to support and process said multiple substrates at once.

Additionally or alternatively, multiple registration elements may be arranged by the registration actuator into a registering state on the support body based on a shape of the substrate to register the specific substrate in the preselected position. For example, a first set of registration elements and second set of registration elements can be arranged and positioned into the registering state to define two aligning edges respectively, which aligning edges are mutually arranged to be conformal to corresponding edges of the specific substrate.

In examples, the registration actuator may be electromagnetic device for moving and mounting the registration element by providing a magnetic force, may be a mechanical device for mounting and moving the registration element by clamping the registration element or may be a powered screw-driver for rotatably driving the registration element, such as a screw having a screw head.

In examples, the registration element may be a registration pin, may be a registration ruler having an alignment edge extending in a first direction, may be a registration element having a first alignment edge extending in a first direction and a second alignment edge extending in a second direction, or may be any other registration element for registering a substrate by urging an edge of the substrate in contact to the registration element.

In an embodiment, the apparatus further comprises a control unit arranged for controlling the registration actuator. In this way, the control unit controls the position of each of the registration elements in the registering state on the support body.

The control unit may be arranged to control the registration actuator based on the preselected position of the substrate, such as a preselected position based on a predetermined number and sizes of a plurality of substrates to be supported on the support body.

Additionally, the control unit may be arranged to control the registration actuator based on a predetermined shape of the substrate, such as based on a predetermined shape of an edge of the substrate.

In an embodiment, the support body comprises a retaining mechanism to retain the registration element in the registering state. In examples, the retaining mechanism may comprise at least one receiving hole to retain the registration element in the registering state, may comprise at least one receiving slot, may comprise at least one fastening element, such as a clamp, or may comprise a attracting device, such as a suction source providing a suction force through a receiving hole for retaining the registration element or a magnetic source providing a magnetic force for retaining the registration element in the registering state.

In an embodiment, said at least one registration element is positioned and arranged for not registering the substrate on the support body when brought into a standby state.

In this embodiment a position of the standby state of the registration element is selected for not engaging or for not obstructing the substrate in the preselected position on the support body. In particular, the standby state may be any position wherein the registration element is temporarily held to be processed, on demand, by the registration actuator.

In an embodiment, the registration actuator is movably arranged with respect to the support body for selectively arranging the registration elements into the standby state.

The advantage is that the registration actuator may selectively remove one of the registration elements, a portion of the registration elements or all of the registration elements from the registering state into the standby state, thereby clearing space on the support body for supporting another substrate in another preselected position. As a result, a process of exchanging and/or rearranging substrates on the support body is enhanced.

Furthermore, the registration elements in the standby state are available to be processed, on demand, by the registration actuator.

In an embodiment, in the standby state the registration element is positioned outside and away from the support body.

The advantages is that a simple structure may be used for storing the registration element in the standby state and that the same registration element may easily be arranged by the registration actuator in the registering state at various positions with respect to a support surface of the support body. The support surface of the support body is arranged for supporting the substrate in the preselected position.

Furthermore, this embodiment enhances a simple structure of the support body as the support body does not need to accommodate the registration element in the standby state.

In an embodiment, the apparatus further comprises a container arranged for storing a registration element in the standby state.

The advantage of the container is that the position and condition of the registration element in the standby state is controlled by the container. In particular, the container may be arranged for storing a plurality of registration elements. This embodiment supports, that the registration actuator may easily process one or more registration elements supplied from the same container.

In an embodiment, the container comprises a revolving mechanism arranged for circulating a plurality of registration elements inside the container and selectively providing a registration element of the plurality of registration elements to the registration actuator.

The advantage is that the container supports accurate and selectively supply of one or more registration elements to the registration actuator. For example, the plurality of registration elements may comprise various types of registration elements and the revolving mechanism may be arranged for selectively supplying a registration element of a selected type of registration elements to the registration actuator.

In an embodiment, in the standby state the registration element is positioned inside the support body.

The advantage is that the registration element is readily available at the support body in the standby state and may be accurately positioned with respect to a support surface of the support body.

For example, the registration element is arranged inside the support body in the standby state at a preselected position with respect to a support surface of the support body before being arranged by the registration actuator into the registering state, thereby protruding from the support body at the same preselected position. The registration actuator is moved towards the preselected position and subsequently the registration actuator moves the registration element at the preselected position from inside the support body towards a protruding registering state on the support body, e.g. by moving the registration element in a direction perpendicular to a support surface of the support body.

In an embodiment, the support body further comprises a plurality of suction holes being distributed over the support body for providing a suction force to a contact side of the substrate.

The suction holes support the holding of the substrate to the support body, i.e. onto a support surface of the support body, in the preselected position. This has the advantage that registration elements can be removed from the registering state, such as moved to a standby state, while maintaining the substrate registered on the support body in the preselected position.

In an embodiment, said at least one registration element is positioned and arranged for closing a suction hole when brought into an enclosure state.

The registration element in the enclosure state may at the same time be arranged protruding from support body in a registering state of the registration element or may at the same time be arranged inside the suction body in the suction hole without protruding from the support body in a standby state of the registration element.

The advantage of the registration element in the enclosure state is that the registration element prevents a loss of suction force through the closed suction hole. The registration element may be arranged by the registration actuator in the enclosure state in a selected suction hole. For example, based on the preselected position of each of the substrates processed at the same time, the registration actuator may be arranged for selectively closing suction holes by registering elements, which suction holes are not covered by the substrates.

In an embodiment the enclosure state of the registration element may be in the same position with respect to a support surface of the support body as the standby state of the registration element inside the support body.

This has the advantage that the registration element is readily available at the support body in the standby state at the preselected position and is easily moved into the enclosure state by the registration actuator at the same preselected position.

In an embodiment, said at least one registration element comprises a connecting portion, which is shaped to fit into a suction hole and to retain the registration element in the registering state.

The connecting portion has the advantage that the registration element is easily positioned and retained in the suction hole in the registering state. Additionally the registration element is easily positioned and retained in the enclosure state and the registering state at the same time. A suction force provided through the suction hole enhances retaining the registration element in the suction hole in the registering state.

In an embodiment, the registration element may further comprise a protruding portion shaped to not fit into the suction hole for protruding from the support body in the registering state. For example, the protruding portion may comprise a pin element, having a diameter which exceeds a diameter of the suction hole. The advantage is that a protruding height of the registration element above the support body is accurately defined by the protruding portion.

In an embodiment, the apparatus is a printing apparatus for printing on the substrate, wherein the printing apparatus further comprises a print head and a carriage, the print head arranged for printing on the substrate and the carriage movably arranged for moving the print head with respect to the support body and wherein, in operation of the registration actuator, the carriage is arranged for moving the registration actuator with respect to the support body.

The printing apparatus is arranged for printing on an outer surface of the substrate, after the substrate is accurately registered in the preselected position on the support body.

This embodiment has the advantage that the carriage is used both for moving the print head with respect to the substrate, i.e. during printing, and for moving the registration actuator with respect to the support body, i.e. for arranging the registration element into the registering state at a desired position and/or arranging the registration element into the standby state.

In another aspect of the present invention, a method is provided for positioning a substrate on a support body, the support body being comprised in an apparatus, the apparatus further comprising at least one registration element and a registration actuator, the method comprising the steps of:

a) selecting a position of the substrate on the support body;
b) selecting a position for a first registration element in a registering state for registering the substrate on the support body in the preselected position selected in step a); and
c) moving the registration actuator with respect to the support body to arrange the first registration element into the registering state at the selected position of step b) on the support body.

The selection in step b) of the position of the first registration element in the registering state is to register the substrate in the preselected position. In step c) the registration actuator moves with respect to the support body to arrange the first registration element into the registering state at the selected position of the first registration element. The advantage is that the registration actuator may easily actuate the registration element into the registering state on any position of the support body based on the position of the registering state is selected in step b). Furthermore, step c) enables the actuation of a first registration element into the registering state at the selected position of step b) independently of any other registration element.

In an embodiment, multiple registration elements may be arranged into the registering state in respective positions according to step c), which positions are selected for each registration elements according to step b) independently of one another.

In an embodiment, step b) comprises selecting positions for an assembly of registration element for registering the substrate on the support body in the preselected position selected in step a), wherein the respective positions of said assembly of registration element is based on a shape of the substrate. For example, in case of a circular shaped substrate, the selected positions for the assembly of registration element are mutually arranged to define an alignment edge being conformal to the circular edge of the substrate.

In an embodiment, the method further comprises the step of:

d) moving the registration actuator with respect to the support body to arrange the first registration element into a standby state, wherein in the standby state the registration element is positioned and arranged for not registering the substrate on the support body.

The advantage is that registration actuator can easily and selectively remove a registration element from the registering state into the standby state after the substrate has been registered on the support body. As a result, a process of exchanging or rearranging substrates on the support body is enhanced.

Furthermore, the registration elements in the standby state are available to be processed, on demand, by the registration actuator.

In an embodiment, in step d) in the standby state the registration element is arranged outside and away from the support body.

The advantage is that a simple structure may be used for storing the registration element in the standby state and that the same registration element may be arranged on demand by the registration actuator in the registering state at various positions with respect to a support surface of the support body.

In an embodiment, in step d) in the standby state the registration element is arranged inside the support body.

The advantage is that the registration element is readily available at the support body in the standby state and may be accurately positioned with respect to a support surface of the support body.

In this embodiment, the registration element does not need to be moved towards the support body as it is already arranged inside the support body in the standby state.

In an embodiment of the apparatus, the apparatus further comprises a control unit arranged to control the registration actuator to perform the method according to the present invention.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

Hereinafter, the present invention is further elucidated with reference to the appended drawings showing non-limiting embodiments and wherein.

DETAILED DESCRIPTION OF EMBODIMENTS

Figure 1:
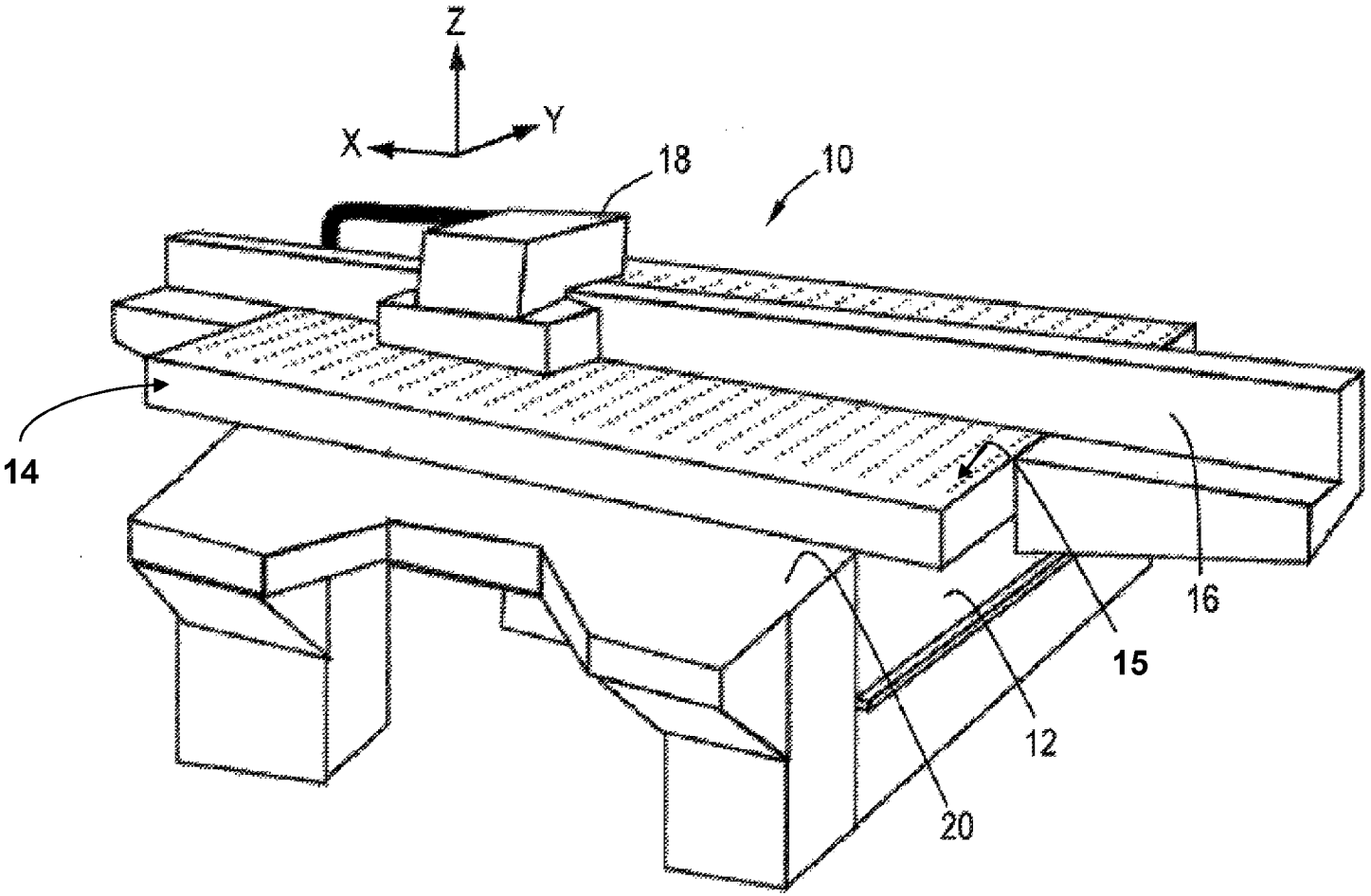
FIG. 1 shows a schematic view of a prior art print engine in which a method according to the invention may be used.

The present invention will now be described with reference to the accompanying drawings, wherein the same reference numerals have been used to identify the same or similar elements throughout the several views.

FIG. 1 shows a printing device 10 for printing an image or text on a relatively large substrate, in particular on a relatively large and flat substrate. Such a printing device 10 is well known in the art. The printing device 10 comprises a support assembly 12 on which a support body 14 is mounted comprising a printing surface 15 for supporting said substrate. As illustrated, the printing surface 15 may be provided with suction holes for pulling the substrate onto the printing surface 15 and thereby holding the substrate flat on the printing surface 15 of the support body 14. A guiding assembly 16 is provided for supporting and guiding a carriage 18. The carriage 18 is movably supported by the guiding assembly 16 such that the carriage 18 may be moved over the printing surface 15. For example, the guiding assembly 16 may be movably supported on the support assembly 12 such that the guiding assembly may be moved in a y-direction (as indicated in FIG. 1) and the carriage 18 may be moveably supported by the guiding assembly 16 such that the carriage may be moved in a x-direction guided by the guiding assembly 16. The carriage 18 is provided with a printing element such as an inkjet print head for printing the image or the text on the substrate arranged on the printing surface 15 by ejecting ink drops at preselected positions. It is noted that the guiding assembly 16 and/or the carriage 18 may be supported such that they may be moved in a z-direction, thereby enabling to print on different media (i.e. substrates) having a different dimension in the z-direction (when positioned on the printing surface 15).

Figure 2:
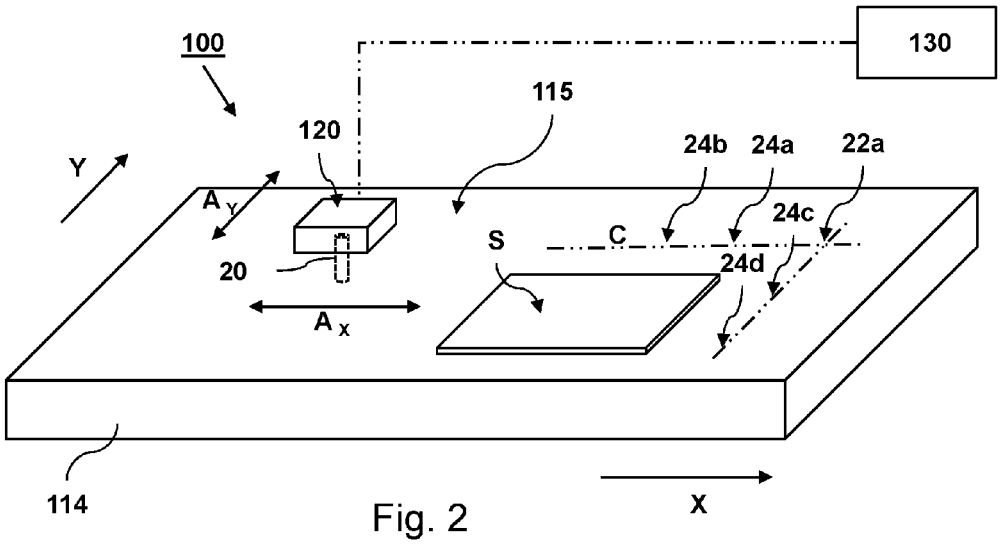
FIG. 2 shows a schematic view of an apparatus according to the present invention.

FIG. 2 shows a schematic perspective view of an apparatus according to the present invention. The apparatus 100 comprises a support body 114 for supporting a substrate S on a support surface 115, at least one registration element 20, a registration actuator 120 and a control unit 130. The support body 114 including the support surface 115 extends in a direction X and a direction Y normal to the direction X.

Said registration actuator 120 is arranged facing the support surface 115 and is movably arranged with respect to the support surface 115 of the support body 114 as indicated by arrows $A_x$ and $A_y$. The direction $A_x$ is parallel to the direction X and the direction $A_y$ is parallel to the direction Y of the support surface 115. The registration actuator 120 is arranged to position and arrange the at least one registration element 20 into a registering state on the support surface 115 independently of one another. In examples, the registration actuator 120 may be electro-magnetic device for moving and mounting the registration element 20 by providing a magnetic force, may be a mechanical device for mounting and moving the registration element 20 by clamping the registration element 20 or may be a powered screw-driver for rotatably driving the registration element 20, such as a screw having a screw head.

In the FIG. 2 a preselected position 22*a* on the support surface 115 of the support body 114 is shown for registering the substrate S. In the example shown in FIG. 2, the substrate S is a rectangular substrate.

To register the rectangular substrate S on the preselected position 22*a* on the support surface 115, i.e. having a corner of the substrate S arranged at the position as indicated by arrow 22*a*,two edges of the substrate S need to be registered by the at least one registration element, such as a registration pin.

The control unit 130 is operatively connected to the registration actuator for controlling the registration actuator 120. The control unit 130 controls and knows the position of each of the registration elements 20 in the registering state on the support body 114.

The control unit 130 is arranged to control the registration actuator 120 based on the preselected position 22*a* of the substrate S.

Additionally, the control unit 130 may be arranged to control the registration actuator 120 based on a predetermined shape of the substrate S, i.e. based on a predetermined shape of an edge of the substrate S.

To register a first edge of the substrate S two positions 24*a*, 24*b* are selected, i.e. controlled by the control unit 130, for positioning a first registration pin and a second registration pin respectively to define a first registration line C. To register a second edge of the substrate S two positions 24*c*, 24*d* are selected for positioning a third registration pin and a fourth registration pin respectively to define a second registration line. The first registration line and the second registration line have a crossing point at the preselected position 22*a* on the support surface 115. In this way, the substrate S may be registered on the preselected position 22*a* by urging an edge of the substrate S in contact with the at least one registration element 20.

The preselected position 22*a* may be suitably selected, for example based on a size and/or shape of the substrate S, such as by the control unit 130.

The registration element 20 may in examples be a registration pin, a registration ruler having an alignment edge extending in a first direction or may be a registration element having a first alignment edge extending in a first direction and a second alignment edge extending in a second direction.

The registration element 20 may be transported by the registration actuator 120 to any of the selected positions 24*a*-24*d* to be arranged in the registering state. An example is further explained in relation to the embodiment of FIG. 3A-3D.

Alternatively the registration element 20 may be available in the support body 114 in any of the selected positions 24*a*-24*d* to be arranged in the registering state. An example is further explained in relation to the embodiment of FIG. 4A-4D.

A registration element 20, when brought in the registering state, is positioned and arranged for registering the substrate Son the support surface 115, i.e. by urging an edge of the substrate S in contact to the registration element 20.

In alternative embodiments the registration actuator 120 may be movably arranged with respect to the support surface 115 inside the support body 114 or below the support body 114 facing another surface of the support body 114 arranged opposite to the support surface 115.

FIGS. 3A-3D schematically show an embodiment of an apparatus and a method to be used in the apparatus according to the present invention. The apparatus 100 comprises the support body 114 for supporting a substrate S on a support surface 115, at least one registration element 20*a*, the registration actuator 120 and the control unit 130, as shown in FIG. 2.

FIGS. 3A-3D show a detailed cross section of the support body 114 in the X direction of the support surface 115.

Figure 3A:
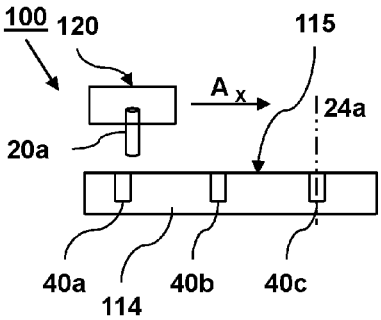
FIGS. 3A-3D schematically show an embodiment of an apparatus and a method to be used in the apparatus according to the present invention.

FIG. 3A shows a first stage of the method according to the present invention to be used in the apparatus 100. In the first stage the registration element 20*a*, which is mounted on the registration actuator 120, is moved by the registration actuator 120 over the support surface 115 in a direction as indicated by arrow $A_x$ towards a preselected position 24*a* of the support surface 115, also shown in FIG. 2. The support body 114 comprises a retaining mechanism, such as a plurality of receiving holes 40*a*-40*c* distributed over the support surface 115. A third receiving holes 40*c* is arranged at the preselected position 24*a*. Each of the receiving holes 40*a*-40*c* is shaped for accommodating a part of the registration element 20*a* and retaining the registration element 20*a* in the registering state.

Figure 3B:
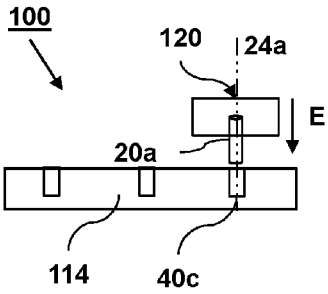

FIG. 3B shows a second stage of the method according to the present invention to be used in the apparatus 100. In the second stage the registration element 20*a* is arranged by the registration actuator 120 above the third receiving hole 40*c* in the preselected position 24*a*. The registration actuator 120 moves the registration element 20*a* in an engaging direction as indicated by arrow E to partly arrange the registration element 20*a* into the receiving hole 40*c*.

Figure 3C:
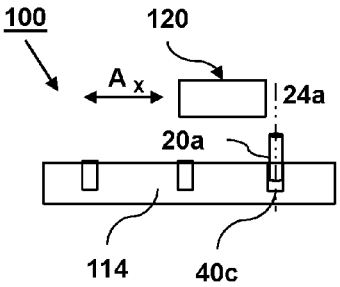

FIG. 3C shows a third stage of the method according to the present invention to be used in the apparatus 100. In the third stage the registration element 20*a* is arranged in the registering state in the preselected position 24*a*. The registration actuator 120 is moved over the support surface 115 away from the registration element 20*a* in the direction as indicated by arrow $A_x$. Alternatively, the registration actuator 120 may be moved over the support surface 115 in any other direction to clear the support surface 115.

The sequence of first stage, second stage and third stage of the method may be repeated to arrange another registration element 20*a* on another selected position of the support surface 115 to register the substrate S in the preselected position 22*a* (shown in FIG. 2).

After sufficient registration elements 20*a* have been arranged in selected positions on the support surface 115 to register the substrate S, in a next stage (not shown) edges of a substrate S may be urged against the at least one registration element 20*a* arranged in the registering state to register the substrate S on the support surface 115 in the preselected position 22*a* (shown in FIG. 2).

After the substrate S has been processed according to appropriate processes, such as printing an image on an outer surface of the substrate S, fixing the image to the substrate S and/or cutting the substrate S, the substrate is removed from the support surface 115.

Figure 3D:
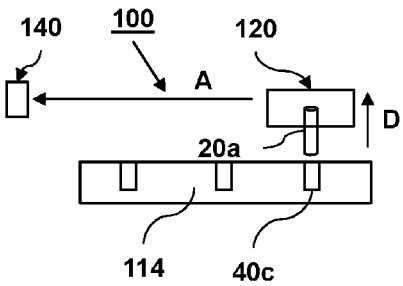

FIG. 3D shows a fourth stage of the method according to the present invention to be used in the apparatus 100. In the fourth stage the substrate S has been removed from the support surface 115. The registration actuator 120 is arranged facing the support surface 115 at the preselected position 24*a* of the registration element 20*a*. The registration actuator 120 moves the registration element 20*a* in a disassemble direction as indicated by arrow D to remove the registration element 20*a* from the receiving hole 40*c*.

In a next stage the registration element 20*a* is moved by the registration actuator 120 in a direction A to a standby state, such as a position in a container 140 arranged away from the support body 114. In the standby state the registration element 20*a* is stored and arranged for not registering the substrate S on the support body 114. The container 140 may be arranged adjacent to a side of the support body 114 in the direction X and may be adapted for storing a plurality of registration elements 20*a*.

FIGS. 4A-4D schematically show another embodiment of an apparatus and a method to be used in the apparatus according to the present invention. The apparatus 200 comprises a support body 214 for supporting a substrate S on a support surface 215, a plurality of registration elements 20*b*, a registration actuator 120 and a control unit 130, as shown in FIG. 2.

FIGS. 4A-4D show a detailed cross section of the support body 214 in the X direction of the support surface 215. The support body 214 comprises a retaining mechanism, such as retaining holes 140*a*-140*c*. A third retaining hole 140*c* is arranged at the preselected position 24*a*, also shown in FIG. 2. Each of the retaining holes 140*a*-140*c* is shaped for fully accommodating a registration element 20*b* and storing the registration element 20*b* inside the respective retaining hole 140*a*-140*c* close to the support surface 215.

Figure 4A:
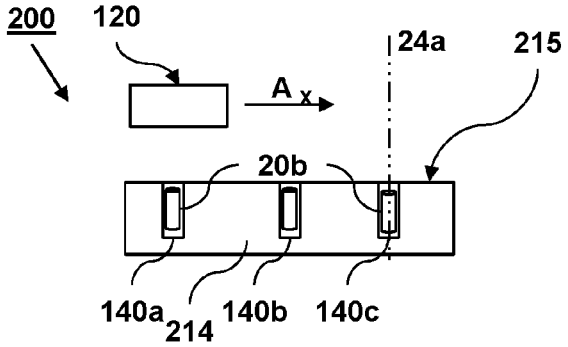
FIGS. 4A-4D schematically show another embodiment of an apparatus and a method to be used in the apparatus according to the present invention.

FIG. 4A shows a first stage of the method according to the present invention to be used in the apparatus 200. In the first stage the registration actuator 120 is moved over the support surface 215 in a direction as indicated by arrow $A_x$ towards a preselected position 24*a* of the support surface 215. In the preselected position 24*a* a retaining hole 140*c* is arranged inside the support body 214 and encloses a registration element 20*b*. The registration element 20*b* of each retaining holes 140*a*-140*c* is disposed inside the respective retaining holes 140*a*-140*c* in a standby state. The registration element 20*b* in the standby is arranged below the support surface 215 for not registering a substrate on the support body 214.

Figure 4B:
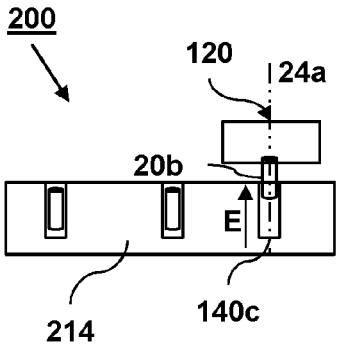

FIG. 4B shows a second stage of the method according to the present invention to be used in the apparatus 200. In the second stage the registration actuator 120 is arranged above the third retaining hole 140*c* in the preselected position 24*a*. The registration actuator 120 moves the registration element 20*b* from the third retaining hole 140*c* in an engaging direction as indicated by arrow E to arrange a first part of the registration element 20*b* protruding from the support surface 214 in a registering state. In the registering state a second part of the registration element 20*b* is arranged inside the third retaining hole 140*c* for keeping the registration element 20*b* stationary with respect to the support surface 215.

Figure 4C:
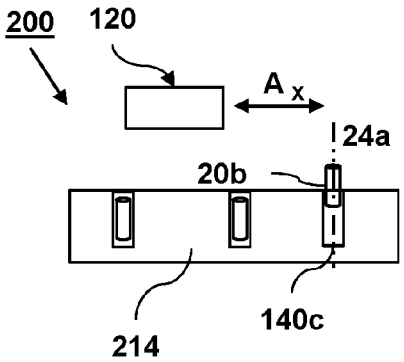

FIG. 4C shows a third stage of the method according to the present invention to be used in the apparatus 200. In the third stage the registration element 20*b* is maintained in the registering state in the preselected position 24*a* by the third retaining hole 140*c*. The registration actuator 120 is moved over the support surface 215 away from the registration element 20*b* in the direction as indicated by arrow $A_x$. Alternatively, the registration actuator 120 may be moved over the support surface 215 in any other direction to clear the support surface 215.

The sequence of first stage, second stage and third stage of the method may be repeated to arrange another registration element 20*b* on another selected position of the support surface 215 to register the substrate S in the preselected position 22*a* (shown in FIG. 2).

After sufficient registration elements 20*b* have been arranged in selected positions on the support surface 115 to register the substrate S, in a next stage (not shown) edges of a substrate S may be urged against the at least one registration element 20*b* arranged in the registering state to register the substrate S on the support surface 215 in the preselected position 22*a* (shown in FIG. 2).

After the substrate S has been processed according to appropriate processes, such as printing an image on an outer surface of the substrate S, fixing the image to the substrate S and/or cutting the substrate S, the substrate is removed from the support surface 215.

Figure 4D:
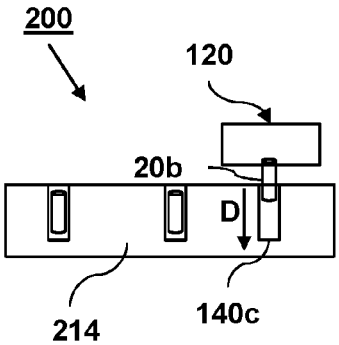

FIG. 4D shows a fourth stage of the method according to the present invention to be used in the apparatus 200. In the fourth stage the substrate S may have been removed from the support surface 215. The registration actuator 120 is arranged facing the support surface 215 at the preselected position 24*a* of the registration element 20*b*. The registration actuator 120 moves the registration element 20*b* in a downwards direction as indicated by arrow D to move the protruding first part of the registration element 20*b* back into the receiving hole 140*c*. In this way, the registration element 20*b* is fully accommodated again inside the receiving hole 140*c* in a standby state. As such, the registration element 20*b* remains available close to the support surface 215 while not obstructing a substrate on the support surface 215.

Figure 5A:
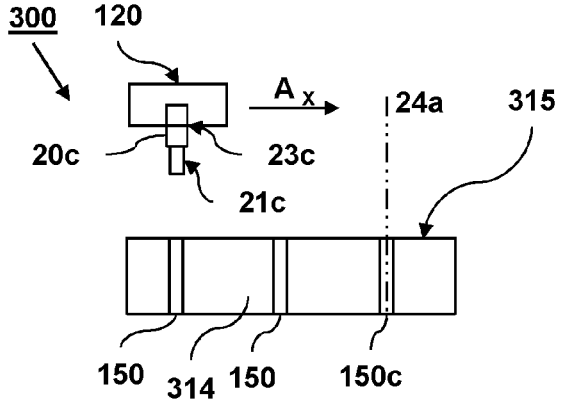
FIGS. 5A-5C schematically show an embodiment of an apparatus and a method to be used in the apparatus according to the present invention.
Figure 5B:
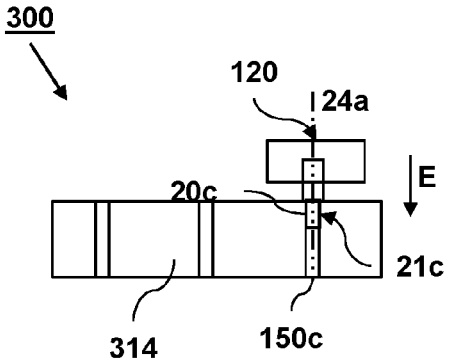
Figure 5C:
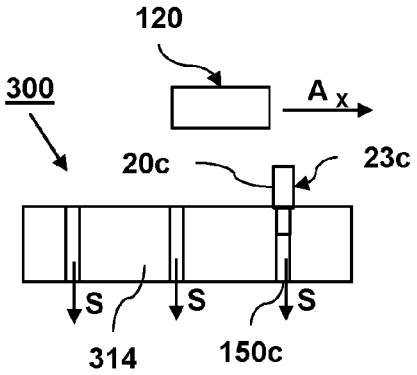

FIGS. 5A-5C schematically show another embodiment of an apparatus and a method to be used in the apparatus according to the present invention. The apparatus 300 comprises a support body 314 for supporting a substrate S on a support surface 315 of the support body 314, at least one registration element 20*c*, a registration actuator 120 and a control unit 130, as shown in FIG. 2.

FIGS. 5A-5C show a cross section of the support body 314 in the X direction of the support surface 315. The support body 314 further comprises a plurality of suction holes 150 being distributed over the support surface 315 of the support body 314 for providing a suction force (as indicated by arrow S) to a contact side of the substrate, when arranged in contact to the support surface 315. One of the suction holes 150*c* is arranged at the preselected position 24*a*, as also shown in FIG. 2.

The at least one registration element 20*c* comprises a first connecting portion 21*c* shaped to fit into a suction hole 150 and a second protruding portion 23*c* arranged to not accommodate into the suction hole 150. For example, the suction hole is a tube having a diameter of 2 mm, the first connecting portion 21*c* is a pin having a diameter of about 2 mm or less than 2 mm and the second protruding portion 23*a* is a pin having a diameter of more than 2 mm.

FIG. 5A shows a first stage of the method according to the present invention to be used in the apparatus 300. In the first stage the registration element 20*c*, which is mounted on the registration actuator 120, is moved by the registration actuator 120 over the support surface 315 in a direction as indicated by arrow $A_x$ towards the suction hole 150*c* arranged at preselected position 24*a* of the support surface 315.

FIG. 5B shows a second stage of the method according to the present invention to be used in the apparatus 300. In the second stage the registration element 20*c* is arranged by the registration actuator 120 above the suction hole 150*c* in the preselected position 24*a*. The registration actuator 120 moves the registration element 20*c* in an engaging direction as indicated by arrow E to arrange the first connecting portion 21*c* of the registration element 20*c* into the suction hole 150*c* in a registering state. In the registering state the second protruding portion 23*c* remains protruding from the support body 315. The registration element 20*c* is at the same time in an enclosure state, as the first connecting portion 21*c* and/or the second protruding portion 23*c* of the registration element 20*c* closes the suction hole 150*c*.

FIG. 5C shows a third stage of the method according to the present invention to be used in the apparatus 300. In the third stage the registration element 20*c* is arranged in the registering state in the preselected position 24*a*. The registration actuator 120 is moved over the support surface 315 away from the registration element 20*c* in the direction as indicated by arrow $A_x$. Alternatively, the registration actuator 120 may be moved over the support surface 315 in any other direction to clear the support surface 315.

The registration element 20*c* is retained by the suction hole 150*c* in the registering state.

Additionally a suction force S may be provided in the suction hole 150*c* to further enhance retaining the first part 21*c* of the registration element 20*c* inside the suction hole 150*c*.

The sequence of first stage, second stage and third stage of the method may be repeated to arrange another registration element 20*c* on another selected position of the support surface 315 in one of the other suction holes 150 in order to register the substrate S in the preselected position 22*a* (as shown in FIG. 2).

After sufficient registration elements 20*c* have been arranged in the registering state in selected positions on the support surface 315 to register the substrate S, in a next stage (not shown) edges of a substrate S may be urged against the at least one registration element 20*c* arranged in the registering state to register the substrate S on the support surface 315.

After the substrate S has been processed according to appropriate processes, such as printing an image on an outer surface of the substrate S, fixing the image to the substrate S and/or cutting the substrate S, the substrate is removed from the support surface 315.

Figure 6:
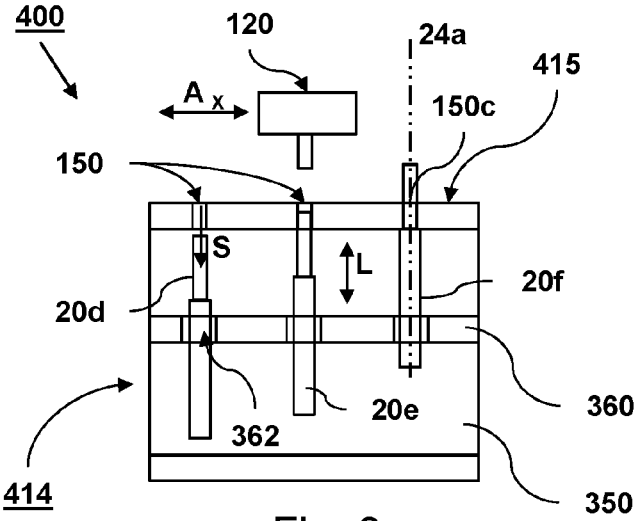
FIG. 6 schematically shows a detailed view of another embodiment of an apparatus according to the present invention.

FIG. 6 schematically shows a detailed view of another embodiment of an apparatus according to the present invention. The apparatus 400 comprises a support body 414 for supporting a substrate S on a support surface 415 of the support body 414, a plurality of registration elements 20*d*-20*f*, a registration actuator 120 and a control unit 130, as shown in FIG. 2.

FIG. 6 shows a cross section of the support body 414 in the X direction of the support surface 415. The support body 414 comprises a plurality of suction holes 150 being distributed over the support surface 415 of the support body 414 for providing a suction force (as indicated by arrow S) to a contact side of the substrate, when arranged in contact to the support surface 415. One of the suction holes 150*c* is arranged at the preselected position 24*a*, as also shown in FIG. 2.

The support body 414 further comprises a suction chamber 350 arranged in fluid communication to the plurality of suction holes 150 for providing the suction force to each of the suction holes 150. Inside the suction chamber 350 a retaining assembly 360 is arranged in the form of a structure arranged for supporting each of the registration elements 20*d*-20*f*. Each of the registration elements 20*d*-20*f* is arranged concentric to one of the suction holes 150 and is movably supported by retaining assembly 360 in an up-down direction as indicated by arrow L in at least three levels (lower level, middle level and upper level). The retaining assembly 360 comprises a plurality of retaining holes 362, all arranged for retaining one of the registration elements 20*d*-20*f* stationary, while allowing a sliding movement of the corresponding registration elements 20*d*-20*f* in the up-down direction L in case the registration actuator 120 provides a force on the registration elements 20*d*-20*f* in the up-down direction as indicated by arrow L.

At the first level, i.e. lower level in direction L, each of the registration elements 20*d*-20*f* is arranged in a standby state, as shown in FIG. 6 for registration element 20*d*. At the first level the registration element 20*d* does not register or obstruct a substrate S on the support surface 415 and does not close the suction hole 150.

At the second level, i.e. middle level in direction L, each of the registration elements 20*d*-20*f* is arranged a combination of an enclosure state and a standby state, as shown in FIG. 6 for registration element 20*e*. At the second level the registration element 20*e* closes the corresponding suction hole 150 and does not register or obstruct a substrate S on the support surface 415.

At the third level, i.e. upper level in direction L, each of the registration elements 20*d*-20*f* is arranged in a combination of an enclosure state and a registering state, as shown in FIG. 6 by registration element 20*f*. At the third level the registration element 20*f* closes the suction hole 150 and in part protrudes from the support surface 415 for registering a substrate S on the support surface 415.

The registration actuator 120 is movably arranged with respect to the support surface 415 as indicated by arrow $A_x$ while facing the support surface 415. In case the registration actuator 120 is arranged facing a suction hole 150, the registration actuator 120 is able to provide a force onto the corresponding registration element 20*d*-20*f* arrange at the position of the suction hole 150. For example, the registration actuator 120 may comprise an electro-magnetic device arranged for pulling the registration element 20*d*-20*f* upwards or pushing the registration element 20*d*-20*f* downwards in the direction L.

In this way, the registration actuator 120 can selectively arrange each of the registration element 20*d*-20*f* in one of the three levels (lower level, middle level and upper level) independently of one another.

After sufficient registration elements 20*d*-20*f* have been arranged in the registering state in selected positions on the support surface 415 to register the substrate S, in a next stage (not shown) edges of a substrate S may be urged against the at least one registration element 20*d*-20*f* arranged in the registering state to register the substrate S on the support surface 415.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A printing apparatus, the apparatus comprising:

a support body for supporting a substrate, the support body comprising a substrate support surface extending in a plane, the plane extending in a first direction and a second direction normal to the first direction;

at least one registration element, wherein said at least one registration element is positioned and arranged for registering the substrate in a preselected position on the substrate support surface when brought into a registering state; and a registration actuator configured for selectively arranging the at least one registration element into the registering state, wherein the registration actuator is configured to translate over the substrate support surface parallel to the plane of the substrate support surface.

2. The printing apparatus according to claim 1, further comprising a print head and a carriage, the print head arranged for printing on the substrate and the carriage movably arranged for moving the print head with respect to the support body and wherein, in operation of the registration actuator, the carriage is arranged for moving the registration actuator with respect to the support body.

3. The printing apparatus according to claim 1, wherein the apparatus further comprises a control unit configured for:

selecting a position on the substrate support surface for the registration element, and controlling the registration actuator to translate over the support body parallel to the first direction and the second direction to the selected position.

4. The printing apparatus according to claim 1, wherein the registration actuator is further arranged for moving the registration element in a direction perpendicular to the substrate support surface of the support body to bring the registering element in a registering state.

5. The printing apparatus according to claim 1, wherein said at least one registration element is positioned and arranged for not registering the substrate on the support body when brought into a standby state.

6. The printing apparatus according to claim 5, wherein in the standby state the registration element is positioned inside the support body.

7. The printing apparatus according to claim 5, wherein the registration actuator is movably arranged with respect to the support body for selectively arranging the registration elements into the standby state.

8. The printing apparatus according to claim 5, wherein in the standby state the registration element is positioned outside and away from the support body.

9. The printing apparatus according to claim 8, wherein the apparatus further comprises a container arranged for storing a registration element in the standby state.

10. The printing apparatus according to claim 1, wherein the support body further comprises a plurality of suction holes being distributed over the support body for providing a suction force to a contact side of the substrate.

11. The printing apparatus according to claim 10, wherein said at least one registration element is positioned and arranged for closing a suction hole when brought into an enclosure state.

12. The printing apparatus according to claim 10, wherein said at least one registration element comprises a connecting portion, which is shaped to fit into a suction hole and to retain the registration element in the registering state.

13. The printing apparatus according to claim 1, further comprising:

a print head for printing on a substrate; and a carriage arranged movably with respect to the support body, wherein, in operation of the registration actuator, the carriage is arranged for moving the registration actuator with respect to the support body parallel to the first direction and the second direction.

14. The printing apparatus according to claim 13, wherein the carriage is further movably arranged for moving the print head with respect to the support body.

15. A method for positioning a substrate on a support body, the support body being comprised in a printing apparatus and comprising a substrate support surface extending in a plane, the plane extending a first direction and a second direction normal to the first direction, the apparatus further comprising at least one registration element and a registration actuator, the method comprising the steps of:

a) selecting a position of the substrate on the substrate support surface of the support body;

b) selecting a position for a first registration element in a registering state for registering the substrate on the support body in the preselected position selected in step a); and c) moving the registration actuator with respect to the substrate support surface of the support body to arrange the first registration element into the registering state at the selected position of step b) on the substrate support surface of the support body in a direction parallel to the plane of the substrate support surface.

16. The method according to claim 15, wherein the method further comprises the step of:

d) moving the registration actuator with respect to the support body to arrange the first registration element into a standby state, wherein in the standby state the registration element is positioned and arranged for not registering the substrate on the support body.

17. The method according to claim 16, wherein in step d) in the standby state the registration element is arranged outside and away from the support body.

18. The method according to claim 16, wherein in step d) in the standby state the registration element is arranged inside the support body.

* * * * *